US011371205B2

(12) United States Patent
Myer et al.

(10) Patent No.: US 11,371,205 B2
(45) Date of Patent: Jun. 28, 2022

(54) INSULATION SYSTEM FOR A BUILDING

(71) Applicant: 1563100 Alberta Ltd., Okotoks (CA)

(72) Inventors: Jerry Myer, Foothills (CA); Joshua Kulbaba, Foothills (CA); Scott Myer, Calgary (CA)

(73) Assignee: 1563100 ALBERTA LTD.

( * ) Notice: Subject to any disclaimer, the term of this patent is extended or adjusted under 35 U.S.C. 154(b) by 7 days.

(21) Appl. No.: 16/947,839

(22) Filed: Aug. 19, 2020

(65) Prior Publication Data

US 2021/0054589 A1 Feb. 25, 2021

Related U.S. Application Data

(60) Provisional application No. 62/889,328, filed on Aug. 20, 2019.

(51) Int. Cl.

| | |
|---|---|
| ***E02D 27/01*** | (2006.01) |
| ***E04B 2/02*** | (2006.01) |
| ***E04B 1/78*** | (2006.01) |
| ***E02D 31/14*** | (2006.01) |
| *E04B 1/20* | (2006.01) |
| *E04B 1/76* | (2006.01) |
| *E04B 1/26* | (2006.01) |

(52) U.S. Cl.

CPC ..... *E02D 27/01* (2013.01); *E02D 31/14* (2013.01); *E04B 1/78* (2013.01); *E04B 2/02* (2013.01); *E02D 2200/1657* (2013.01); *E02D 2250/00* (2013.01); *E02D 2300/0048* (2013.01); *E04B 1/20* (2013.01); *E04B 1/26* (2013.01); *E04B 2001/7679* (2013.01)

(58) Field of Classification Search

CPC ..... E02D 27/016; E02D 29/025; E04B 1/04; E04B 1/043; E04B 2/02; E04B 2002/0204; E04B 2002/0206

USPC ..... 405/229; 52/293.2, 294

See application file for complete search history.

(56) References Cited

U.S. PATENT DOCUMENTS

| | | | | | |
|---|---|---|---|---|---|
| 825,903 | A * | 7/1906 | Hallberg | E02D 27/02 | 52/294 |
| 3,685,241 | A * | 8/1972 | Cooper | E04B 1/04 | 52/270 |
| 4,067,166 | A * | 1/1978 | Sheahan | E02D 29/0241 | 405/284 |
| 4,798,036 | A * | 1/1989 | Pardo | E02D 27/00 | 52/293.2 |
| 5,367,845 | A * | 11/1994 | Hartling | E02D 27/02 | 52/293.1 |

(Continued)

FOREIGN PATENT DOCUMENTS

| | | | | |
|---|---|---|---|---|
| CA | 2191491 A1 * | 5/1998 | | E04B 1/04 |
| DE | 19934494 A1 * | 2/2000 | | E02D 29/025 |

(Continued)

*Primary Examiner* — Frederick L Lagman

(74) *Attorney, Agent, or Firm* — Holland & Hart LLP

(57) ABSTRACT

The present disclosure provides an insulation system for a building. The insulation system comprises a wall section adapted to be installed at least partially between two vertically oriented posts of a building, and a base section configured to be interconnected to the wall section and comprising a surface extending outwardly and downwardly away from an outer surface of the wall section when the insulation system is installed at the building.

17 Claims, 6 Drawing Sheets

(56) References Cited

U.S. PATENT DOCUMENTS

| | | | | | |
|---|---|---|---|---|---|
| 6,141,936 | A * | 11/2000 | Butler, Jr. | E02D 27/42 | 52/169.9 |
| 6,205,726 | B1 * | 3/2001 | Hoadley | E04B 2/16 | 52/309.12 |
| 6,244,009 | B1 * | 6/2001 | Cerrato | E04B 2/08 | 52/223.7 |
| 8,011,158 | B1 * | 9/2011 | Powell | E04B 1/0007 | 52/742.14 |
| 8,464,482 | B2 * | 6/2013 | Raynor | E04C 3/34 | 52/296 |
| 9,404,234 | B2 * | 8/2016 | Jain | E04B 2/22 | |
| 2014/0150362 | A1 * | 6/2014 | Propst | E04B 1/941 | 52/309.12 |
| 2014/0237922 | A1 * | 8/2014 | Jain | E04B 2/08 | 52/293.2 |

FOREIGN PATENT DOCUMENTS

| | | | | |
|---|---|---|---|---|
| EP | 0079887 | B1 * | 12/1988 | E02D 29/0266 |
| EP | 984118 | A2 * | 3/2000 | E04B 1/04 |
| FI | 125970 | B * | 5/2016 | E02D 29/025 |
| WO | WO-2011111002 | A1 * | 9/2011 | E04B 2/02 |

* cited by examiner

INSULATION SYSTEM FOR A BUILDING

CROSS-REFERENCE TO RELATED APPLICATION

This application claims priority to and benefit of U.S. Provisional Patent Application Ser. No. 62/889,328 filed on Aug. 20, 2019, which is hereby incorporated by reference.

TECHNICAL FIELD

The present disclosure relates generally to an insulation system for a building, in particular an insulation system for post-frame buildings to control frost heave.

BACKGROUND

A common area of heat loss in a building is the foundation, which typically is located partly above grade and partly below grade. The foundation is often constructed of building materials such as concrete, stone or masonry. While providing necessary building strength and support, such materials are typically porous and do not provide adequate insulation.

Increasingly, local building codes are requiring foundations to be insulated. Foundations may be insulated at the interior or the exterior depending upon preference and design of the foundation.

Today, almost any low-rise structure can be quickly and reliably built using a post-frame construction method. The post-frame construction method is a method whereby large posts are buried in the ground or anchored to a foundation (i.e., concrete slab) to provide vertical structural support and whereby girts are attached between adjacent posts to provide horizontal support.

When overlying frost-susceptible soils, the slab may be subjected to frost heave unless the soil is kept relatively dry, is prevented from freezing, or a combination thereof. Frost heave, in the case of post-frame construction, can result in differential movement between the slab and embedded posts and can result in severe structural damage.

In many foundations, especially those of residential houses and buildings, it is advantageous to insulate the foundation on the outside because doing so facilitates installation and helps prevent moisture penetration, while at the same time facilitating water drainage. Insulating foams such as those of rigid extruded polystyrene and expanded polystyrene have been employed in the form of rectangular panels or boards on the exterior of foundation walls to provide necessary insulation, prevent moisture penetration, and facilitate drainage.

Post-frame buildings are typically insulated by installing rigid foam boards or other similar traditional insulating materials on the outside edge and entire underside of the building's slabs. A problem with employing rigid foam boards or any other similar traditional insulating material on the exterior of post-frame buildings, however, is that although insulation located under the building's slabs prevents heat loss, it may not prevent soil directly under each slab from freezing at locations near the building perimeter. Another problem with such systems, particularly with insulating material located on the outside edge of a building, is that the joints between rigid foam boards must be taped or caulked to prevent outside air from flowing into the building.

Therefore, a need exists for an insulation system for a building that provides better protection against frost heave, in particular for a post-frame construction. Ideally, the insulation system is economic, effective and easy to install.

SUMMARY

The present disclosure recognizes that there are problems in the current existing technologies in respect of building insulation systems, including insulation systems for post-frame buildings.

An advantage of the present disclosure is the provision of a building insulation system having improved characteristics over existing technologies. For example, in an aspect, the present disclosure provides an insulation system that can better protect against frost heaves.

The insulation system of the present disclosure comprises both a vertical insulation (wall section) and a horizontal insulation (base section), whereby the base section has a sloped design allowing for drainage away from the building.

In an embodiment, the present disclosure relates to an insulation system for a building, the insulation system comprising: a wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and a base section comprising a base section top, a base section bottom, and two opposing base sides, the base section top comprising a surface extending outwardly and downwardly away from the outer surface of the wall section when the insulation system is installed at the building.

In some embodiments, the wall section and base section are separate pieces adapted to be connected together using a notched/keyway design (e.g. tongue and groove). An advantage of this design is that it further aids in preventing frost penetration. Additionally, the unique design of the wall section and base section are advantageous in eliminating waste while cutting from a block of insulation.

The present disclosure further provides a kit-of-parts for insulating a building, such as a post-frame building, the kit-of-parts comprising at least one wall section as described herein and at least one base section as described herein.

In an embodiment, the present disclosure thus relates to a kit-of-parts for insulating a building, the kit-of-parts comprising: at least one wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and at least one base section comprising a base section top, a base section bottom, and two opposing base sides, the base section top comprising a surface extending outwardly and downwardly away from the outer surface of the wall section when the insulation system is installed at the building.

The present disclosure further provides a method for manufacturing a building insulation system comprising a wall section and a base section as described herein, the method comprising cutting a first single block of insulation material into numerous wall sections; and cutting a second single block of insulation material into numerous base sections. In an embodiment, the blocks of insulation material are cut into the wall section pieces and the base section pieces with a minimal amount of waste material. In an embodiment, the method further comprises cutting or forming a tongue-and-groove connection in opposing surfaces of the wall section and the base section such that they are capable of being connected together as described herein.

In an embodiment, the present disclosure thus relates to a method for manufacturing a building insulation system, the method comprising: cutting a first single block of insulation material into two or more wall sections, each of said wall sections adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and cutting a second single block of insulation material into two or more base sections, each of said base sections comprising a base section top, a base section bottom, and two opposing base sides, the base section top comprising a surface extending outwardly and downwardly away from the outer surface of the wall section when the insulation system is installed at the building.

In another embodiment, the present disclosure relates to a cost-effective method of shipping the wall section pieces and the base section pieces, wherein the wall section pieces and the base section pieces are formed in accordance with the methods disclosed herein and remain in stacked configuration for shipping.

BRIEF DESCRIPTION OF THE FIGURES

Further advantages, permutations and combinations of the invention will now appear from the above and from the following detailed description of the various particular embodiments of the invention taken together with the accompanying drawings, each of which are intended to be non limiting, in which.

DETAILED DESCRIPTION

Figure 1A:
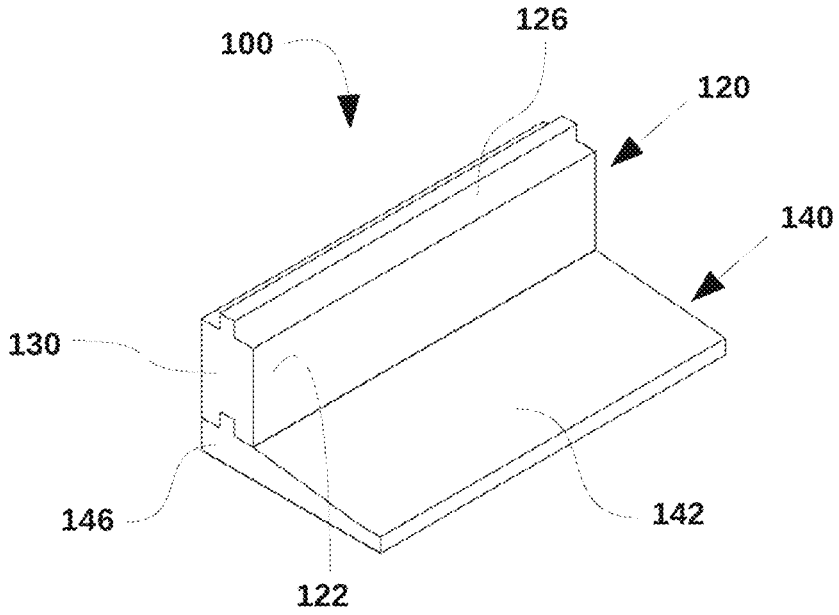
FIG. 1A is a perspective view of an exemplary insulation system of the present disclosure comprising a wall section and a base section.

It is an objective of the present disclosure to provide an advantageous insulation system for a building, in particular for post-frame buildings. More particularly, it is an objective to provide better insulation systems for the protection of post-frame buildings against frost heave, and for these insulation systems to have a cost-effective method of manufacture and shipping.

An advantage of the design of the presently disclosed insulation system is that it better prevents water and moisture from accessing the soil underneath and/or surrounding a building foundation (e.g. concrete floor slab). This is accomplished through a variety of unique features, such as a sloped base design and interconnected base and wall components.

As used herein, the term "insulation system" is meant to refer to an insulation product for a building, the components of which work together to insulate a building or a portion thereof. In an embodiment, the insulation system is for insulating around the exterior wall or surface of a foundation of a building, such as around a concrete wall or a concrete slab, preferably a concrete slab. In an embodiment, the building is a post-frame building or post-frame construction having a concrete slab foundation. Herein, the terms "post-frame building" and "post-frame construction" are used interchangeably.

The insulation systems as disclosed herein comprise a wall section and a base section. As used herein, by "wall section" it is meant a portion or component of the insulation system that extends upwards above the base section, generally taking the shape or function of a wall of insulation, when installed. The wall section is adapted to be installed at least partially between two vertically oriented posts of a building. The height of the wall section may extend at least partially above or below the length of the posts. The width of the wall section may extend at least partially beyond the width of the posts. In an embodiment, the wall section is contained completely between two vertically oriented posts of a building, when installed.

As used herein, by "base section" it is meant a portion or component of the insulation system that extends outwardly away from the building in relation to the wall section, when installed. The base section has a top surface that extends outwardly and downwardly away from the building when installed. This design allows for drainage away from the building.

In an embodiment, the wall section and the base section are a monolithic structure. By "monolithic structure", it is meant that the wall section and the base section are made or formed of a single piece of material. In a preferred embodiment, the base section and the wall section are separate pieces that are adapted to be interconnected to each other. This later embodiment may be advantageous in respect of increased manufacturing and shipping efficiencies, as well as ease of installation.

Reference will now be made in detail to exemplary embodiments of the disclosure, wherein numerals refer to like components, examples of which are illustrated in the accompanying drawings that further show exemplary embodiments, without limitation. The exemplary embodiments described herein and as shown in the examples are embodiments in which the wall section and the base section are separate pieces that may be interconnected, however the disclosure herein is equally applicable to a monolithic structure whereby the wall section and base section are made of a single piece of material. The difference being that the monolithic structure embodiments need not be configured to be interconnected (e.g. by a tongue-and-groove connection) since they are already one unit.

Insulation System

In an embodiment, the present disclosure relates to an insulation system for a building, the insulation system comprising: a wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and a base section comprising a base section top, a base section bottom, and two opposing base sides, the base section top comprising a surface extending outwardly and downwardly away from the outer surface of the wall section when the insulation system is installed at the building.

The insulation systems disclosed herein provide a unique design for protecting floor slabs of buildings, such as post-frame buildings, thereby controlling frost heave. Further, the insulation system allows for economical and efficient installation of insulation at a post-frame building.

As will be described in more detail below, an embodiment of the insulation system uses separate pieces of insulation material for the wall section and the base section, whereby the separate pieces may be interconnected to each other. In an embodiment, the wall section and the base section may be permanently interconnected. For example, a fastening means (e.g. glue or another adhesive) may be used to connect the sections. Alternatively, the wall section and the base section may be reversibly interconnected. Furthermore, the wall sections may be stacked on top of each other when installed at a building to provide insulation to any desired height.

In an embodiment, the interconnection between the wall section and the base section is positioned below ground level and the same wall section extends upwards above ground level. As used herein, "ground level" refers to the level of the earth at a given location. Soil or dirt may be removed to install the insulation system below ground level, and then re-filled. Having a single wall section span a distance both above and below ground level may be advantageous in preventing potential damage caused by an accumulation of surface water around the building's perimeter, particularly during rainy seasons or when snow melts during springtime.

Figure 1B:
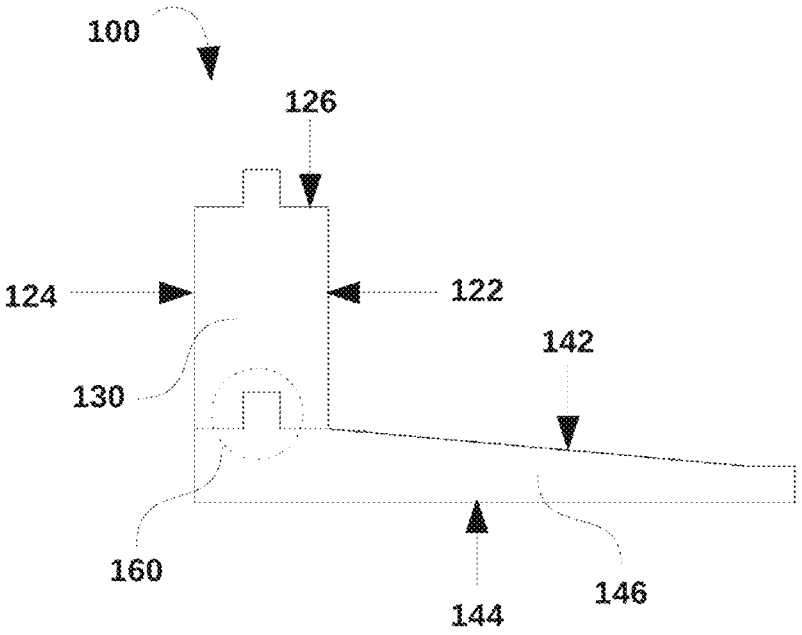
FIG. 1B is a schematic side view of the insulation system shown in FIG. 1A.
Figure 2A:
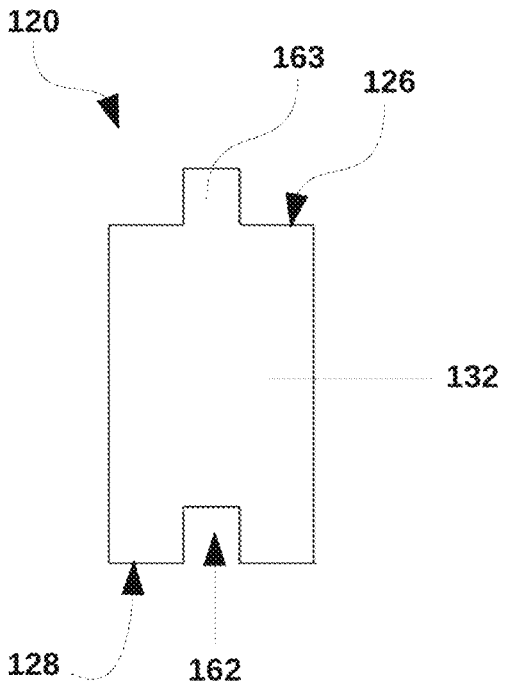
FIG. 2A is a schematic side view of the wall section shown in FIGS. 1A and 1B.
Figure 2B:
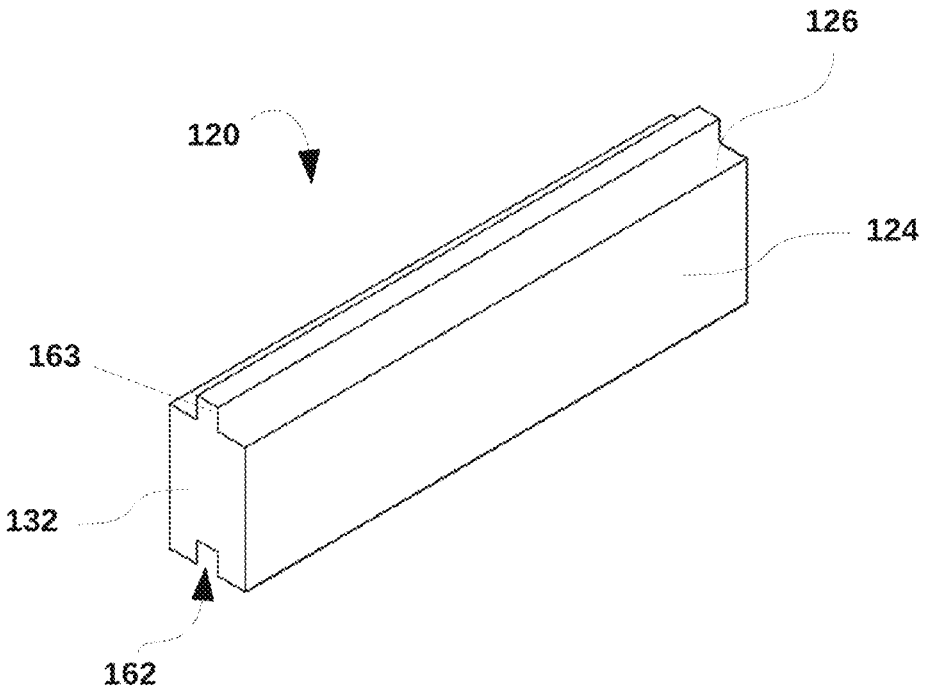
FIG. 2B is a perspective view of the wall section shown in FIGS. 1A and 1B.

Turning now to FIGS. 1A and 1B, an insulation system of the present disclosure is shown and is generally identified using reference numeral 100. In this embodiment, the insulation system 100 comprises two separate pieces: a wall section 120 and a base section 140. The wall section 120 is in a substantially rectangular shape and comprises an outer surface 122 to be oriented towards the exterior of the building, an inner surface 124 to be oriented towards the interior of the building, a wall section top 126, a wall section bottom 128, and two opposing wall sides 130 and 132 (hidden).

In FIGS. 1A, 1B, 2A and 2B, the wall section 120 is shown as a rectangular shape having a length that is longer than the height. Depending on the building design, spacing of the posts, desired parameters of the building insulation, or any combination thereof, the wall section 120 may have a height that is greater than the length or the height and length may be about equal (i.e. a square). The dimensions of height, length and width/thickness of the wall section 120 can be adjusted for any given application.

The height of the wall section 120 is measured from the wall section top 126 to the wall section bottom 128. In an embodiment, the height of the wall section 120 is between about 6 inches and about 48 inches. In an embodiment, the height of the wall section 120 is between about 6 inches and about 30 inches. In an embodiment, the height of the wall section 120 is about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, about 21 inches, about 22 inches, about 23 inches, about 24 inches, about 25 inches, about 26 inches, about 27 inches, about 28 inches, about 29 inches, about 30 inches, about 31 inches, about 32 inches, about 33 inches, about 34 inches, about 35 inches, or about 36 inches. In an embodiment, the height of the wall section 120 is about 12 inches.

The height of the wall section 120 that connects to the base section 140 may be of a different height than that of a wall section 120 that is stacked on top of another wall section 120 (in embodiments in which the insulation system 100 comprises stacked wall sections). For example, the wall section 120 that connects to the base section 140 may have an increased height in order to sufficiently span from above to below ground level and extend underground a sufficient distance. In other embodiments, all of the wall sections 120 may be of equivalent height.

The length of the wall section 120 is measured as the distance from one wall side 130 to the other opposing wall side 132. In an embodiment, the length of the wall section 120 is between about 12 inches and about 120 inches. In an embodiment, the length of the wall section 120 is between about 36 inches and about 96 inches. In an embodiment, the length of the wall section 120 is about 12 inches, about 18 inches, about 24 inches, about 30 inches, about 36 inches, about 42 inches, about 48 inches, about 54 inches, about 60 inches, about 66 inches, about 72 inches, about 78 inches, about 84 inches, about 90 inches, or about 96 inches. In an embodiment, the length of the wall section 120 is about 48 inches. In an embodiment, the length of the wall section 120 is about 72 inches. In an embodiment, the length of the wall section 120 is about 96 inches. As described below, the wall section may have different lengths at different regions (e.g. upper versus lower region).

The wall section 120 is of a suitable length such that it can be installed between two vertically oriented posts of a building. As used herein, by "posts" it is meant any vertical support member for a building. In an embodiment, it is a post used in a post-frame construction. The post is typically wood, but may have a cement base to support the wooded post. As used herein, "posts" refer to both wooded or concrete support members. In a preferred embodiment, the length of the wall section 120 is sufficient to span the distance between two adjacent posts. Ideally, the gap between the sides (130 and 132) of the wall section 120 and the post would be as small as possible for insulation purposes. In an embodiment, the wall section 120 is tightly fit between the posts such that there are no gaps between the sides (130 and 132) and the posts. In another embodiment, two or more wall sections 120 may be used to span the distance between two adjacent posts.

The thickness or width of the wall section 120 is measured as the distance between the outer surface 122 and the inner surface 124. In an embodiment, the thickness of the wall section 120 is between about 1 inch and about 18 inches. In an embodiment, the thickness of the wall section 120 is between about 6 inches and about 8 inches. In an embodiment, the thickness of the wall section is about 1 inch, about 1.5 inches, about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, or about 8 inches. In an embodiment, the thickness of the wall section 120 is about 7¼ inches. As described below, the wall section 120 may have a different thickness at different regions (e.g. upper versus lower region).

Depending on the type of post-frame construction, the design of the wall section 120 may be different. One method of manufacturing a post-frame building involves burying the posts underground. In another method of manufacturing a post-frame building, wooden posts are supported above ground by concrete posts that extend underground (e.g. PERMA-COLUMN™). For either of these types of post-frame buildings, the entire height of the wall sections 120 will typically be between the vertical posts (wooden or cement) since they extend underground. In these types of post-frame buildings, the wall sections 120 of FIGS. 1A, 1B, 2A and 2B may be used and the wall sections 120 may have lengths as described above.

In another method of manufacturing a post-frame building, the posts are on a foundation. In these embodiments, if the posts are near the edge of the foundation (e.g. concrete slab), the wall section 120 may be designed differently such that the wall section 120 is configured to be seated on the ledge between the posts. Thus, an upper region of the wall section 120 will be between the posts, and a lower region of the wall section 120 will extend downwards adjacent an exterior surface of the foundation. In an embodiment, the upper region will have a thickness greater than the lower region so that the upper region extends outwards beyond the posts and a thinner lower region extends downwards along the side of the foundation. In another embodiment, the upper and lower region will be of similar thickness, with the wall section 120 substantially in the shape of a "Z", similar to Z-shaped bracket. In these embodiments, the lower region of the wall section 120 extends below ground alongside the foundation (e.g. floor slab).

Since the posts in the above method are on the foundation and do not extend below the ground, it may be beneficial for the lower region of the wall section 120 to have a greater length than the upper region. If the lower region only had a length as long as the distance between the posts, there would be a gap between lower regions of adjacent wall sections 120. Thus, in an embodiment, the upper region may have a first longitudinal length that spans the distance between the posts, and the lower region may have a second longitudinal length that is longer for spanning at least a portion (e.g. half) of the width of an adjacent post. Ideally, the lower regions of the wall section are configured to span the gap and contact an adjacent wall section 120.

Whereas the wall sections 120 are generally intended to take the shape or function of a wall of insulation, the base sections 140 are generally intended to form a base with a top surface that extends outwardly and downwardly away from the building, thereby allowing for drainage away from the building.

Figure 3A:
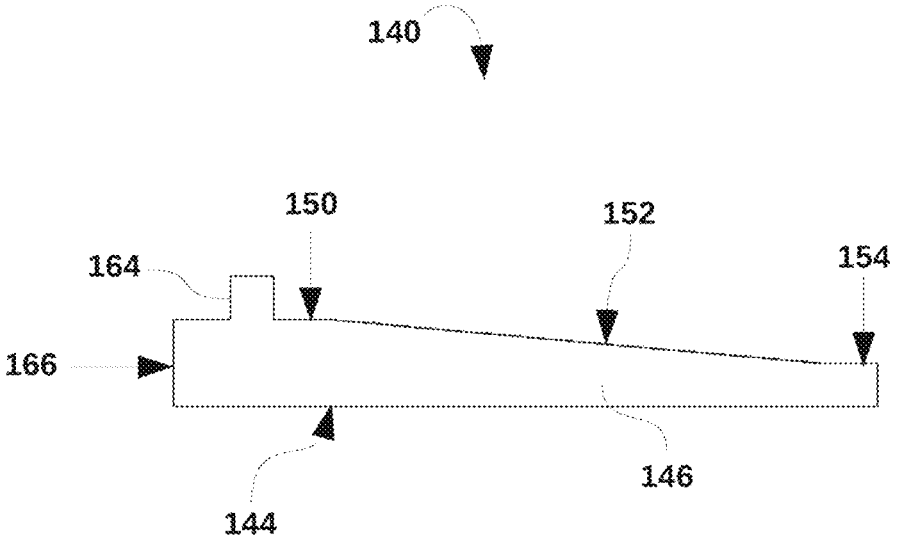
FIG. 3A is a schematic side view of the base section shown in FIGS. 1A and 1B.
Figure 3B:
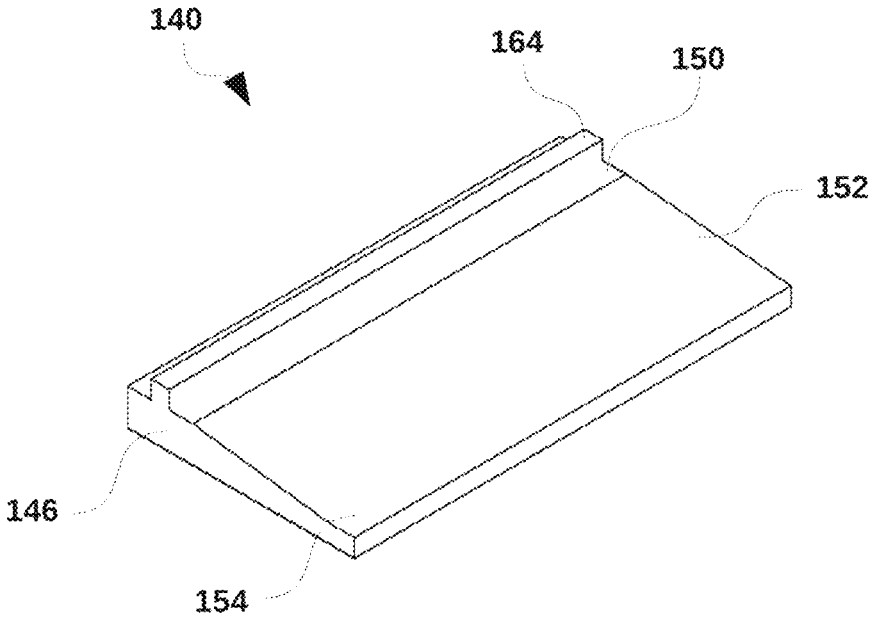
FIG. 3B is a perspective view of the base section shown in FIGS. 1A and 1B.

As shown in FIGS. 1A, 1B, 3A and 3B, the base section 140 comprises a base section top 142, a base section bottom 144, and two opposing base sides 146 and 148 (hidden). The base section top 142 comprises a surface 152 configured to extend outwardly and downwardly away from the outer surface 122 of the wall section 120, when assembled. In an embodiment, the surface 152 extending outwardly and downwardly may extend downwardly along the complete length of the base section 140. In another embodiment, as shown in FIG. 3A, the base section top 142 may comprise a flat surface 150 that is substantially parallel or parallel to the base section bottom 144, as well as the surface 152 configured to extend downwardly and outwardly from the outer surface of the wall section 120. There may also be another flat surface 154 near or at the most outward end of the base section 140.

An advantageous aspect of the base section 140 comprising the flat surface 150 is that it provides a flat region for interconnection of the wall section 120, in order to form a better seal between the wall section 120 and the base section 140. Any type of sealant or waterproofing material or compound may also be used at the junction between the wall section 120 and the base section 140 to further prevent water penetration. However, the inclusion of a tongue-and-groove connection 160 (described later herein) provides a sealing means and may avoid the need for additional sealants.

Figure 5A:
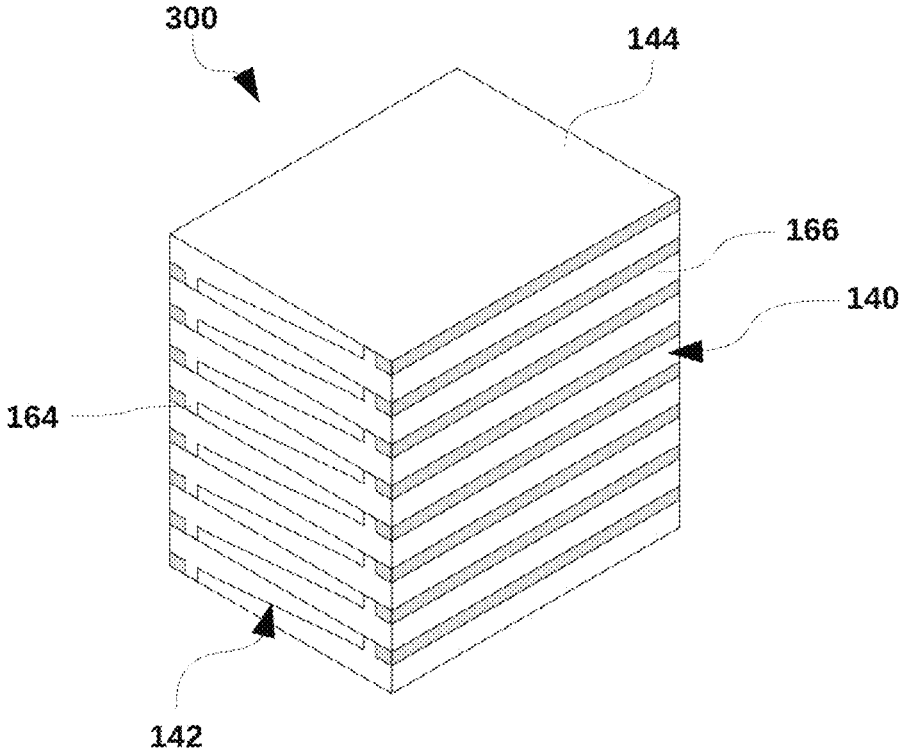
FIG. 5A is a perspective view of a plurality of base sections shown in FIGS. 3A and 3B interconnected with each other and depicting a manufacturing and shipping method for the base sections.
Figure 5B:
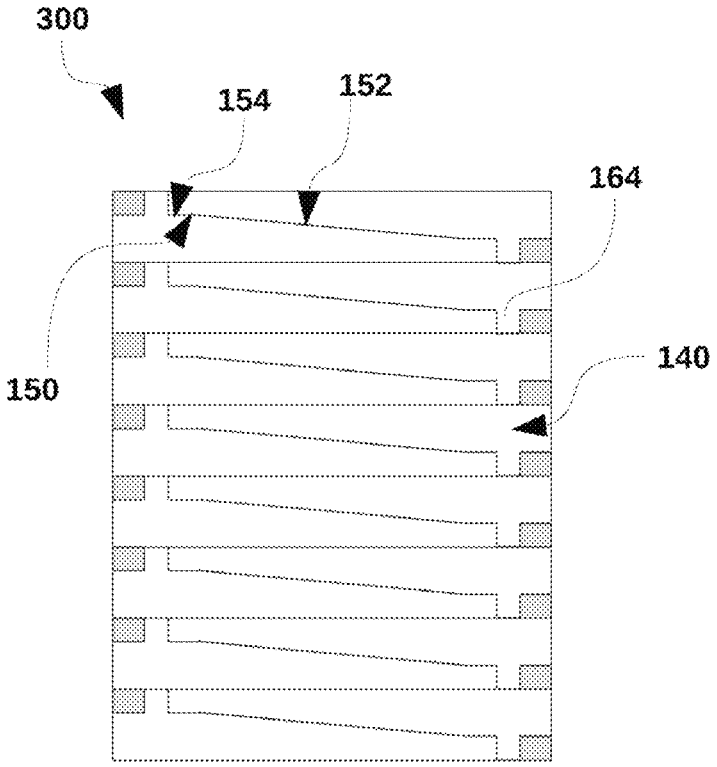
FIG. 5B is a schematic side view of the plurality of base sections shown in FIG. 5A.

The flat surface 154 is largely present due to advantageous manufacturing methods whereby the flat surface 154 is formed by the same cutting of material that forms flat surface 150 on an adjacent base section 140 (see FIGS. 5A and 5B where flat surface 150 and 154 are complementary surfaces of the same cut of insulation material).

The surface 152 extending outwardly and downwardly away from the outer surface 122 of the wall section 120 is advantageous in allowing for drainage away from a building. In an embodiment, surface 152 has a downward grade of between about 2 degrees and about 20 degrees. In an embodiment, surface 152 has a downward grade of between about 3 degrees and about 10 degrees. In an embodiment, surface 152 has a downward grade of about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, or more. In an embodiment, surface 152 has a downward grade of about 5 degrees. The downward grade should be sufficient to drain any accumulated subsurface frost to ensure that structural elements of the post-frame building remain dry.

As will be clear, the height of the base section will be different depending on where the measurement is taken along the outwardly and downwardly extending slope. Herein, the height of the base section 140 is measured from the upper most region of the base section top 142 to the base section bottom 144. In an embodiment, the height of the base section 140 is between about 2 inches and about 15 inches. In an embodiment, the height of the base section 140 is between about 3 inches and about 12 inches. In an embodiment, the height of the base section 140 is about 3 inches, about 4 inches, about 5 inches, about 6 inches, or more. In an embodiment, the height of the base section 140 is about 4 inches.

The purpose of surface 152 is to provide for drainage away from the building, and it should extend a sufficient distance to provide this function. In this regard, in an embodiment, the surface 152 will extend outwardly and downwardly away from the outer surface 122 of the wall section 120 by a distance of between about 6 inches and about 36 inches. In an embodiment, the surface 152 will extend outwardly and downwardly away from the outer surface 122 of the wall section 120 by a distance of between about 10 inches and about 30 inches. In an embodiment, the surface 152 will extend outwardly and downwardly away from the outer surface 122 of the wall section 120 by a distance of about 18 inches, about 19 inches, about 20 inches, about 21 inches, about 22 inches, about 23 inches, about 24 inches, about 25 inches, about 26 inches, about 27 inches, about 28 inches, about 29 inches, about 30 inches, or more. In an embodiment, the surface 152 will extend outwardly and downwardly away from the outer surface 122 of the wall section 120 by a distance of about 24 inches.

Notably, a distance of at least 18 inches effectively extends the path along which subsurface heat flows around the building, thereby moving the line of frost penetration (i.e., the depth to which the groundwater in soil is expected to freeze) away from the building's slabs. Moving the frost line away from the building's slabs by a sufficient distance controls heat loss, effectively insulates the building, and prevents frost heave.

The length of the base section 140 is measured as the distance from one base side 146 to the other opposing base side 148. In preferred embodiments, the base section 140 will have a length equivalent to that of the wall section 120 interconnected thereto. In this configuration, the wall section 120 and base section 140 will form a continuous insulation barrier without gaps. As described above, there is more than one type or method of manufacturing a post-frame building. In the designs where the posts (cement, wood or other) are buried in the ground, the wall section 120 as described above is typically a uniform length spanning the distance between the posts. In preferred embodiments, the length of the base section 140 will be equivalent to this uniform length. In embodiments in which the base section 140 is interconnected to the wall section 120 at the wall section bottom 128, the region of the base section 140 aligned below the wall section 120 (see e.g. FIG. 6) may also be positioned between the two vertically oriented posts (posts not shown in FIG. 6). In other embodiments, the base section 140 may be installed at a depth such that it is partially or completely below the posts and thus not between the posts.

Alternatively, in designs where the posts are on a foundation, as described above, the wall section 120 may have an upper region of a first longitudinal length and a lower region of a second longitudinal length. In preferred embodiments, the length of the base section 140 will be equivalent to the second longitudinal length, i.e. the length of the lower region. Through this design, there should be no gaps between adjacent base sections 140 when installed at a building.

Since the base section will typically have a length equivalent to the wall section, the length embodiments described above for the wall section are equally applicable to the base section. Thus, in an embodiment, the length of the base section 140 is between about 12 inches and about 120 inches. In an embodiment, the length of the base section 140 is between about 36 inches and about 96 inches. In an embodiment, the length of the base section 140 is about 12 inches, about 18 inches, about 24 inches, about 30 inches, about 36 inches, about 42 inches, about 48 inches, about 54 inches, about 60 inches, about 66 inches, about 72 inches, about 78 inches, about 84 inches, about 90 inches, or about 96 inches. In an embodiment, the length of the base section 140 is about 48 inches. In an embodiment, the length of the base section 140 is about 72 inches. In an embodiment, the length of the base section 140 is about 96 inches.

Typically, as shown in FIGS. 1A and 3A, each of the two opposing base sides 146 and 148 of the base section 140 are perpendicularly oriented to the base section bottom 144. This design allows one base section 140 to be positioned adjacent to another base section 140 and form a close contact that is capable of preventing drainage from passing through. In some embodiments however, one or both of the opposing base sides (146 and/or 148) may comprise a downward slope. In particular, where the base section 140 is at the end and not adjacent to another base section 140 on one side, it may be advantageous for that side to have a downward slope to aid in drainage.

When the wall section 120 and the base section 140 are separate pieces, they are adapted to be interconnected to each other. By "adapted to be interconnected", it is meant that the wall section 120 and/or the base section include structural features that allow the wall section 120 and base section 140 to be connected. As shown in FIGS. 1A and 1B, in an embodiment the interconnection may be at the wall section bottom 128 and the base section top 142. In another embodiment, the base section 140 may be interconnected to the wall section 120 somewhere along the outer surface 122. In such embodiments, the back side 166 (FIG. 3A) of the base section may be interconnected to the outer surface 122 of the wall section 120. Other configurations of interconnection are also possible and encompassed herein.

As shown in FIGS. 1-3, the wall section 120 and the base section 140 may be configured to be interconnected to each other by a tongue-and-groove connection 160. In an embodiment, the tongue-and-groove connection 160 comprises a longitudinal groove 162 along the wall section bottom 128 configured to engage a corresponding longitudinal tongue 164 along the base section top 142. As will be appreciated, the tongue 164 and groove 162 structures may be reversed with the tongue on the wall section 120 and the groove 162 on the base section 140. However, having the tongue on the base section 140 may be preferred as it would better function to prevent pooling of water, which could occur if the groove 162 were open from above rather than below.

In some embodiments, more than one tongue-and-groove connection 160 may be used to interconnect the wall section 120 and the base section 140. If more than one tongue-and-groove connection 160 is used, both the tongues 164 and grooves 162 will typically be situated at least about 0.5 inches apart from each other. In an embodiment, the tongues 164 and grooves 162 may be situated between about 1 inch and about 6 inches apart from each other. In an embodiment, the tongues 164 and grooves 162 may be situated between about 1.25 inches and about 1.75 inches apart from each other. Although the tongue 164 and groove 162 in FIGS. 1-3 are shown in a longitudinal orientation, in other embodiments the tongue 164 and groove 162 may extend a different direction, such as perpendicular to the length of the wall section 120 and base section 140. In other embodiments, both the tongues 164 and grooves 162 may be situated along the back side 166 of the base section 140 and the outer surface 122 of the wall section 120.

Tongue 164 and grooves 162 may be formed in any manner known in the art. For example, tongues 164 may be formed by cutting a surface or surfaces of the base section 140 to form a protrusion (i.e. tongue) or by attaching protruding structures to a surface or surfaces of the base section 140. Grooves 162 may be cut, impressed, or embossed within a surface or surfaces of the wall section 120.

Ideally, the tongue 164 would be positioned along flat surface 150 on the base section top 142. This will provide for better engagement between the wall section 120 and the base section 140, as opposed to if the tongue 164 were on the sloped surface 152.

The width, height and depth of each tongue 164 and groove 162, as well as the number of tongues 164 and grooves 162, should be sufficient to ensure effective interconnection between the wall section 120 and the base section 140. In an embodiment, tongue 164 height may be between about 1 inch and about 6 inches. In an embodiment, tongue 164 height may be about 1 inch, about 1.5 inches, about 2 inches, about 2.5 inches, about 3 inches, about 3.5 inches, or about 4 inches. In an embodiment, tongue 164 height may be between about 2 inches. Groove 162 depth will be complementary to any selected tongue 164 height. In an embodiment, groove 162 and tongue 164 width may be between about 1 inch and about 6 inches. In an embodiment, groove 162 and tongue 164 width may be about 1 inch, about 1.5 inches, about 2 inches, about 2.5 inches, about 3 inches, about 3.5 inches, or about 4 inches. In an embodiment, groove 162 and tongue 164 width may be between about 2 inches.

Although FIGS. 1A and 1B demonstrate the use of a tongue-and-groove connection 160 for interconnecting the wall section 120 and the base section 140, any structural means of connection known in the art will suffice provided the means of connection is effective, especially when the insulation system 100 disclosed herein is installed at a post-frame building. As another exemplary embodiment, the base section 140 may comprise teeth that fit into corresponding notches in the wall section 120. As a modification to the tongue-and-groove connection 160, the interconnection may be a sliding dovetail joint. This design may be advantageous as it would provide structural reinforcement to prevent the tongue from coming out of the groove 162. However, assembly may not be as convenient as the tongue would need to slide into the groove 162, rather than simply dropping into place.

In addition to the wall section 120 being adapted or configured to be interconnected to the base section 140, separate wall sections 120 may be stacked on top of one another to any desired height to provide a wall of insulation. In an embodiment, similar to the wall-base section interconnection, the wall sections 120 may also be configured to be stackably interconnected to each other by a tongue-and-groove connection 161 (see FIG. 4; showing a configuration for shipping or transport). The wall section top 126 comprises a longitudinal wall section tongue 163 configured to engage the longitudinal groove 162 along the wall section bottom 128 of another of the wall sections 120.

Any number of wall section 120 and base section 140 combinations may be used in the insulation system 100 disclosed herein. In an embodiment, the insulation system 100 comprises or consists of one wall section 120 and one base section 140. In an embodiment, the insulation system 100 comprises or consists of one base section 140 with 2, 3, 4, 5, 6, 7, 8, 9 or 10 wall sections 120 stacked thereon. In an embodiment, the insulation system 100 comprises a sufficient number of base sections 140 to go around the foundation of a building, such as a post-frame building, when installed. In an aspect of this embodiment, when installed each of the base sections 140 that go around the building have at least one wall section 120 interconnected thereto and stacked thereon. As the skilled person will appreciate, the insulation system 100 disclosed herein need not consist of only two pieces, but may instead consist of any number of wall section 120 and base section 140 pieces.

Further, as described herein, the wall section 120 need not be substantially rectangular and the base section 140 need not be in the shape as disclosed in FIGS. 1-3. For example and without limitation, the base section 140 may also be configured or adapted to go around the corner of a building. In such embodiments, the base section 140 may be pie-shaped or, more particularly, shaped like a trapezoid (e.g. an isosceles trapezoid). In this manner, the base section 140 will comprise a longer longitudinal length progressively downwards along the surface 152 extending outwardly and downwardly away from the outer surface 122 of the wall section 120, when installed. Thus, in an embodiment, the shape of certain base sections 140 is capable of rounding the corner.

In an alternative or additional embodiment, the insulation system 100 of the present disclose may further comprise one or more corner connecting pieces. The corner connecting pieces are a separate and distinct structure from the base section 140. These corner connecting pieces may be similarly shaped to the pie-shaped or trapezoid-shaped base sections 140 described above, but they are not typically interconnected to any of the wall sections 120. Rather, the corner connecting pieces could sit adjacent to a base section 140 and comprise a corresponding outwardly and downwardly extending surface to the base section 140, but since they are positioned on a corner, they need not connect to a wall section 120. The adjacent base section 140 would interconnect to the wall section 120. The corner connecting pieces would slot in between two base sections 140 at a corner to fill the gap between the base sections 140 and provide drainage away from the building around the corner.

As the skilled person will appreciate from the present disclosure, any number of different combinations of wall sections 120, base sections 140 and optionally corner connecting pieces may be used in the insulation system 100 to insulate around a building. Advantageously, the insulation system 100 moves the frost line away from the building's slabs by a sufficient distance to control frost heave. Much of the above disclosure has focused on separate wall section 120 and base section 140 components, but in other embodiments the wall section 120 and the base section 140 of the insulation system 100 form a monolithic structure.

Irrespective of design, the wall section 120, the base section and/or optionally any corner connecting pieces may be comprised of an insulation material. In an embodiment, only the wall sections 120 are comprised of insulation material, while the base section 140 and corner connecting pieces (if used) are comprised of a more durable and/or supportive material, such as a hard plastic. In an embodiment, each of the wall section 120, base section 140 and corner connecting pieces (if used) are comprised of insulation material. The insulation material may be any type of insulating material that is available. In an embodiment, the insulation material is selected from spray polyurethane foam (SPF), polystyrene (EPS) fiberglass, mineral wool, cellulose, or any combination thereof.

Figure 6:
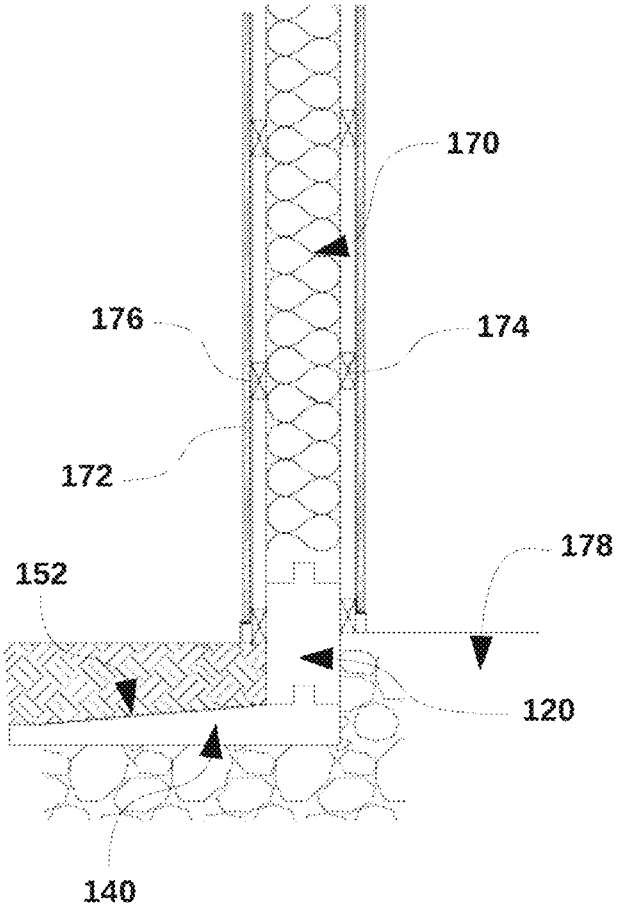
FIG. 6 is a schematic side view of the insulation system shown in FIGS. 1A and 1B installed at a post-frame building.

Turning now to FIG. 6, which shows an exemplary embodiment of the insulation system 100 herein installed at a post-frame building. When the insulation system 100 disclosed herein is installed, the base section 140 is positioned underground with surface 152 extending outwardly and downwardly away from the outer surface 122 of the wall section 120, and as well downwardly and outwardly away from the building. In the FIG. 6, the posts are not shown. In this type of post-frame construction, the posts would be buried on either side of the length of wall section 120.

Referring still to the exemplary embodiment of FIG. 6, the wall section 120 that connects to the base section 140 is of a sufficient height to span a distance both above and below ground level. In an embodiment, the wall section 120 that connects to the base section 140 extends below ground alongside the foundation or floor slab of the building by a distance of between about 3 inches and about 36 inches, or more. In an embodiment, the wall section 120 that connects to the base section 140 extends below ground by a distance of between about 3 inches and about 18 inches. In an embodiment, the wall section 120 that connects to the base section 140 extends below ground by a distance of about 3 inches, about 4 inches, about 5 inches, about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, about 21 inches, about 22 inches, about 23 inches, or about 24 inches. In an embodiment, the wall section 120 that connects to the base section 140 extends below ground by a distance of about 4 inches. In an embodiment, the wall section 120 that connects to the base section 140 extends below ground by a distance of about 6 inches.

Referring still to the exemplary embodiment of FIG. 6, the wall section 120 spans the entire length of the distance between the posts (not shown). The entire height of the wall section 120 is between the posts (not shown). Also, the portion of the base section 140 that is directly below the wall section 120 is also between the posts (not shown). If there are any gaps between the wall sides (130 and 132) and the posts and/or the base sides (146 and 148) and the posts, this may be sealed using a sealant or insulation material, such as for example spray polyurethane foam (SPF).

Figure 4A:
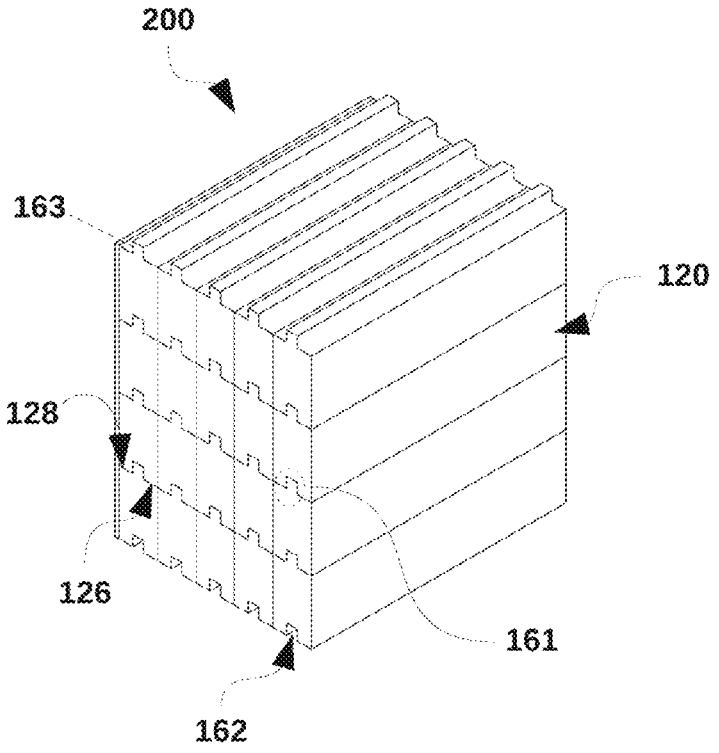
FIG. 4A is a perspective view of a plurality of wall sections shown in FIGS. 2A and 2B interconnected with each other and depicting a manufacturing and shipping method for the wall sections.
Figure 4B:
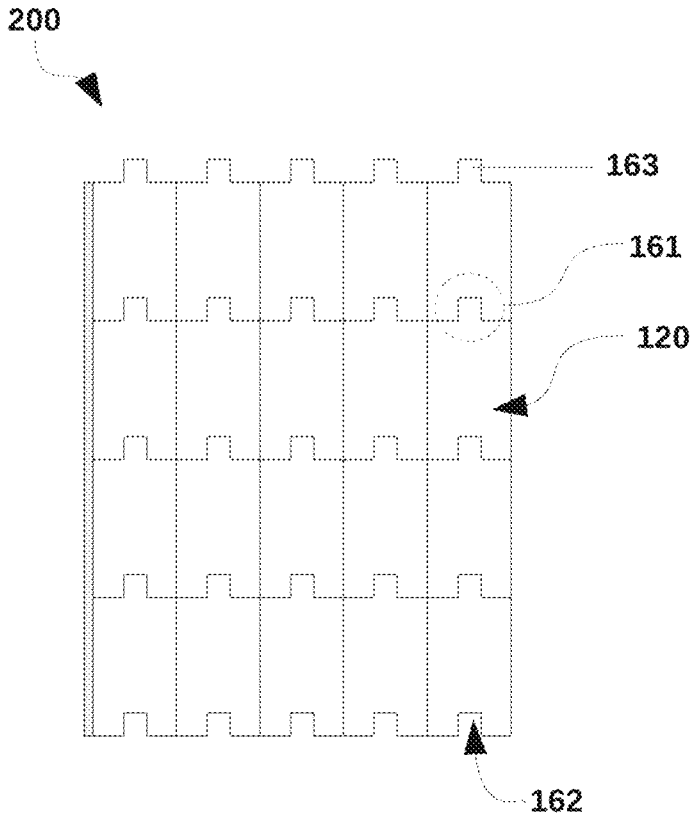
FIG. 4B is a schematic side view of the plurality of wall sections shown in FIG. 4A.

As mentioned hereinbefore and as shown in FIGS. 4A and 4B, the wall sections 120 may be adapted to be stackable on each other. Thus, although not shown in FIG. 6, in an embodiment additional wall section 120 pieces may be stacked on top of the wall section 120 that is shown in order to insulate the walls of the building. In FIG. 6, the wall of the building above wall section 120 is instead insulated with a conventional insulation product 170. Further components of the wall shown in FIG. 6 are the exterior metal liner 172, 2×4 interior strapping 174, and 2×4 exterior strapping 176. The concrete surface 178 is also shown.

As described herein, when the insulation system 100 disclosed herein is installed at a building, such as a post-frame building, the insulation system 100 advantageously functions to prevent potential damage caused by an accumulation of water around the perimeter of the building, particularly during rainy seasons or when snow melts during springtime. Also, the insulation system 100 provides protection against frost heave with both horizontal and vertical insulation and improves drainage away from the building.

Method of Manufacture

The present disclosure further provides a cost-effective and efficient method for manufacturing the insulation system 100 disclosed herein. The disclosed method significantly reduces waste material, thereby increasing cost-efficiency and reducing the time necessary to manufacture the components of the insulation system.

In an embodiment, the present disclosure relates to a method for manufacturing a building insulation system, the method comprising: cutting a first single block of insulation material into two or more wall sections, each of said wall sections adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and cutting a second single block of insulation material into two or more base sections, each of said base sections comprising a base section top, a base section bottom, and two opposing base sides, the base section top comprising a surface extending outwardly and downwardly away from the outer surface of the wall section when the insulation system is installed at the building.

Referring to FIGS. 4A and 4B, an efficient means for cutting the wall sections 120 from a first single block 200 of insulation material is shown. The first single block 200 of insulation material is cut into numerous wall sections 120 with a minimal amount of waste material by a single cut forming the wall section top 126 of a first wall section 120 and the wall section bottom 128 of a second wall section adjacent to (i.e. above) the first wall section 120. In the embodiment shown in FIGS. 4A and 4B, the single cuts between adjacent wall sections 120 are also capable of simultaneously forming the longitudinal groove 162 and longitudinal wall section tongue 163.

Referring to FIGS. 5A and 5B, an efficient means for cutting the base sections 140 from a second single block 300 of insulation material is shown. The second single block 300 of insulation material is cut into numerous base sections 140 with a minimal amount of waste material by a single cut forming the base section top 142 of two oppositely oriented and adjacent base sections 140. In the embodiment shown in FIGS. 5A and 5B, the cuts between adjacent base sections 140 are also capable of simultaneously forming one side of the longitudinal tongue 164 of the base section 140 and the outward end of the base section. Only a small amount of waste material (shaded) is shown.

Thus, the present disclosure provides efficient and cost-effective methods of manufacturing the insulation system 100 of the present disclosure. The cut pieces of wall section 120 and base section 140 may be maintained in the stacked or cubed configurations shown in FIGS. 4A, 4B, 5A and 5B for transport and shipping, thereby advantageously reducing the space requirement to transport/ship the components of the insulation system.

Kit-of-Parts

The insulation system 100 of the present disclosure may be provided to a consumer as a kit-of-parts for installation at a building.

In an embodiment, the present disclosure thus relates to a kit-of-parts for insulating a building, the kit-of-parts comprising: at least one wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and at least one base section comprising a base section top, a base section bottom, and two opposing base sides, the base section top comprising a surface extending outwardly and downwardly away from the outer surface of the wall section when the insulation system is installed at the building.

The wall section 120 and the base section 140 of the kit-of-parts may be any embodiment of the wall sections 120 and the base sections 140 as described herein, including both embodiments where the wall section 120 and base section 140 are monolithic or separate pieces.

The kit-of-parts may include any number of wall sections 120 and base sections 140. In an embodiment, the kit-of-parts includes one wall section 120 for every base section 140 contained therein. In other embodiments, the kit-of-parts may contain multiple wall sections 120 for every base section 140 contained therein. This latter embodiment may be advantageous if the consumer wishes to insulate a building with stacked wall sections 120 as described herein.

In an embodiment, the kit-of-parts further comprises one or more base sections 140 that are adapted for rounding a corner, as described herein. In an embodiment, the kit-of-parts further comprises one or more corner connecting pieces, as described herein.

Exemplary Embodiments

The following represent exemplary and non-limiting embodiments of the present disclosure:

(1) An insulation system for a building, the insulation system comprising: a wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and a base section comprising a base section top, a base section bottom, and two opposing base sides, the base section top comprising a surface extending outwardly and downwardly away from the outer surface of the wall section when the insulation system is installed at the building.

(2) The insulation system of paragraph (1), wherein the wall section and the base section are separate pieces that are adapted to be interconnected to each other.

(3) The insulation system of paragraph (2), wherein the wall section is configured to be interconnected with the base section by a tongue-and-groove connection.

(4) The insulation system of paragraph (3), wherein the tongue-and-groove connection comprises a longitudinal groove along the wall section bottom and a longitudinal tongue along the base section top.

(5) The insulation system of paragraph (4), wherein the base section top further comprises a flat surface that is parallel to the base section bottom, and the longitudinal tongue is positioned along the flat surface.

(6) The insulation system of paragraph (4) or (5), wherein the height, width or both the height and width of the longitudinal tongue is between about 1.0 inch and about 2.5 inches.

(7) The insulation system of paragraph (6), wherein the height and width of the longitudinal tongue is about 2 inches.

(8) The insulation system of any one of paragraphs (1) to (7), wherein the wall sections are adapted to be stackable on each other when installed in the building.

(9) The insulation system of paragraph (8), wherein the wall sections are configured to be stackably interconnected to each other by a second tongue-and-groove connection.

(10) The insulation system of paragraph (9), wherein the wall section top comprises a longitudinal wall section tongue configured to engage the longitudinal groove along the wall section bottom of another of the wall sections.

(11) The insulation system of any one of paragraphs (1) to (10), wherein the height of the wall section from the wall section top to wall section bottom is between about 6 inches and about 30 inches.

(12) The insulation system of paragraph (11), wherein the height of the wall section from the wall section top to wall section bottom is about 12 inches.

(13) The insulation system of any one of paragraphs (1) to (12), wherein the height of the base section from an uppermost region of the base section top to the base section bottom is between about 3 inches and about 12 inches.

(14) The insulation system of paragraph (13), wherein the height of the base section from the uppermost region of the base section top to the base section bottom is about 4 inches.

(15) The insulation system of paragraph (1), wherein the wall section and the base section are a monolithic structure.

(16) The insulation system of any one of paragraphs (1) to (15), wherein the surface of the base section that extends outwardly and downwardly away from the outer surface of the wall section has a downward grade of between about 3 degrees and about 10 degrees.

(17) The insulation system of paragraph (16), wherein the surface of the base section that extends outwardly and downwardly away from the outer surface of the wall section has a downward grade of at least 4 degrees.

(18) The insulation system of paragraph (16), wherein the surface of the base section that extends outwardly and downwardly away from the outer surface of the wall section has a downward grade of about 5 degrees.

(19) The insulation system of any one of paragraphs (1) to (18), wherein the surface of the base section that extends outwardly and downwardly away from the outer surface of the wall section, extends away from the outer surface of the wall section by a distance of between about 10 inches and about 30 inches.

(20) The insulation system of paragraph (19), wherein the surface of the base section that extends outwardly and downwardly away from the outer surface of the wall section, extends away from the outer surface of the wall section by a distance of at least 18 inches.

(21) The insulation system of paragraph (19), wherein the surface of the base section that extends outwardly and downwardly away from the outer surface of the wall section, extends away from the outer surface of the wall section by a distance of about 24 inches.

(22) The insulation system of any one of paragraphs (1) to (21), wherein the thickness of the wall section between the outer surface and the inner surface is between about 6 and about 8 inches.

(23) The insulation system of any one of paragraphs (1) to (22), wherein each of the two opposing base sides are perpendicularly oriented to the base section bottom.

(24) The insulation system of any one of paragraphs (1) to (23), wherein, when installed, the base section is underground with the surface that extends outwardly and downwardly away from the outer surface of the wall section also extending away from the building.

(25) The insulation system of any one of paragraphs (1) to (24), wherein, when installed, an upper region of the wall section is between the posts of the building and a lower region of the wall section is adjacent an exterior surface of a floor slab of the building.

(26) The insulation system of paragraph (25), wherein, when installed, the lower region of the wall section extends below ground alongside the floor slab.

(27) The insulation system of paragraph (25) or (26), wherein the upper region is of a first longitudinal length and the lower region is of a second longitudinal length, wherein the second longitudinal length is longer than the first longitudinal length and is adapted for spanning at least a portion of the width of an adjacent post.

(28) The insulation system of paragraph (27), wherein the first longitudinal length spans the entire distance between two adjacent posts of the building.

(29) The insulation system of any one of paragraphs (25) to (28), wherein the length of the base section is equivalent to the length of the lower region of the wall section.

(30) The insulation system of any one of paragraphs (1) to (29), wherein, when installed, the wall section is of a height sufficient to span a distance both above and below ground level.

(31) The insulation system of any one of paragraphs (1) to (30), wherein, when installed, the wall section extends below ground by a distance of between about 3 inches and about 18 inches.

(32) The insulation system of paragraph (31), wherein, when installed, the wall section extends below ground by a distance of at least 4 inches.

(33) The insulation system of paragraph (31), wherein, when installed, the wall section extends below ground by a distance of about 6 inches.

(34) The insulation system of any one of paragraphs (1) to (33), which further comprises one or more corner connecting pieces having a corresponding outwardly and downwardly extending surface to the base section and a rounded profile.

(35) The insulation system of any one of paragraphs (1) to (33), wherein one or more of the base sections is adapted for rounding a corner of the building by comprising a longer longitudinal length progressively downwards along the surface extending outwardly and downwardly away from the outer surface of the wall section.

(36) The insulation system of any one of paragraphs (1) to (35), wherein the wall section and the base section are comprised of an insulation material selected from spray polyurethane foam (SPF), polystyrene (EPS), fiberglass, mineral wool, cellulose, or a combination thereof.

(37) A kit-of-parts for insulating a building, the kit-of-parts comprising: at least one wall section adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and at least one base section comprising a base section top, a base section bottom, and two opposing base sides, the base section top comprising a surface extending outwardly and downwardly away from the outer surface of the wall section when the insulation system is installed at the building.

(38) A method for manufacturing a building insulation system, the method comprising: cutting a first single block of insulation material into two or more wall sections, each of said wall sections adapted to be installed at least partially between two vertically oriented posts of a building, the wall section comprising an outer surface to be oriented towards the exterior of the building, an inner surface to be oriented towards the interior of the building, a wall section top, a wall section bottom, and two opposing wall sides; and cutting a second single block of insulation material into two or more base sections, each of said base sections comprising a base section top, a base section bottom, and two opposing base sides, the base section top comprising a surface extending outwardly and downwardly away from the outer surface of the wall section when the insulation system is installed at the building.

(39) The method of paragraph (38), wherein the first single block of insulation material is cut into the two or more wall sections with a minimal amount of waste material by a single cut forming the wall section top of a first wall section and the wall section bottom of a second wall section adjacent to the first wall section.

(40) The method of paragraph (38), wherein the second single block of insulation material is cut into the two or more base sections with a minimal amount of waste material by a single cut forming the base section top of two oppositely oriented and adjacent base sections.

(41) The method of any one of paragraphs (38) to (40), wherein the cutting steps comprise cutting a tongue into each base section top; and a groove into each wall section bottom, the tongue and the groove shaped to be connectable by a tongue-and-groove connection.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. An insulation system for a post-frame building, the insulation system comprising: at least two vertically oriented posts of the post-frame building;

a wall section configured to be installed at least partially between two vertically oriented posts of the post-frame building, the wall section comprising an outer surface to be oriented towards the exterior of the post-frame building, an inner surface to be oriented towards the interior of the post-frame building, a wall section top, a wall section bottom, and two opposing wall sides; and a base section comprising a base section top, a base section bottom, and two opposing base sides, the base section top comprising a surface extending outwardly and downwardly away from the outer surface of the wall section when the insulation system is installed at the post-frame building, wherein the wall section and the base section are comprised of an insulation material.

2. The insulation system of claim 1, wherein the wall section and the base section are separate pieces that are adapted to be interconnected to each other.

3. The insulation system of claim 2, wherein the wall section is configured to be interconnected with the base section by a tongue-and-groove connection.

4. The insulation system of claim 3, wherein the base section top further comprises a flat surface that is parallel to the base section bottom, and a longitudinal tongue is positioned along the flat surface.

5. The insulation system of claim 1, wherein the wall sections are adapted to be stackable on each other when installed in the post-frame building.

6. The insulation system of claim 5, wherein the wall sections are configured to be stackably interconnected to each other by a tongue-and-groove connection.

7. The insulation system of claim 1, wherein the wall section and the base section are a monolithic structure.

8. The insulation system of claim 1, wherein the surface of the base section that extends outwardly and downwardly away from the outer surface of the wall section has a downward grade of between about 3 degrees and about 10 degrees.

9. The insulation system of claim 1, wherein the surface of the base section that extends outwardly and downwardly away from the outer surface of the wall section, extends away from the outer surface of the wall section by a distance of between about 10 inches and about 30 inches.

10. The insulation system of claim 9, wherein the surface of the base section that extends outwardly and downwardly away from the outer surface of the wall section, extends away from the outer surface of the wall section by a distance of at least 18 inches.

11. The insulation system of claim 1, wherein, when installed, the base section is underground with the surface that extends outwardly and downwardly away from the outer surface of the wall section also extending away from the post-frame building.

12. The insulation system of claim 1, wherein, when installed, an upper region of the wall section is between the posts of the post-frame building and a lower region of the wall section is adjacent an exterior surface of a floor slab of the post-frame building.

13. The insulation system of claim 12, wherein, when installed, the lower region of the wall section extends below ground alongside the floor slab.

14. The insulation system of claim 1, wherein, when installed, the wall section is of a height sufficient to span a distance both above and below ground level.

15. The insulation system of claim 1, wherein, when installed, the wall section extends below ground by a distance of between about 3 inches and about 18 inches.

16. The insulation system of claim 1, wherein the wall section and the base section are comprised of an insulation material selected from spray polyurethane foam (SPF), polystyrene (EPS), fiberglass, mineral wool, cellulose, or a combination thereof.

17. A kit-of-parts for insulating a post-frame building, the kit-of-parts comprising: at least two vertically oriented posts of the post-frame building;

at least one wall section configured to be installed at least partially between two vertically oriented posts of the post-frame building, the wall section comprising an outer surface to be oriented towards the exterior of the post-frame building, an inner surface to be oriented towards the interior of the post-frame building, a wall section top, a wall section bottom, and two opposing wall sides; and at least one base section comprising a base section top, a base section bottom, and two opposing base sides, the base section top comprising a surface extending outwardly and downwardly away from the outer surface of the wall section when the insulation system is installed at the post-frame building, wherein the at least one wall section and the at least one base section are comprised of an insulation material.

* * * * *